US012078187B2

(12) United States Patent
Morikawa et al.

(10) Patent No.: US 12,078,187 B2
(45) Date of Patent: Sep. 3, 2024

(54) IMPELLER, FAN, AND AIR-CONDITIONING APPARATUS

(71) Applicant: Mitsubishi Electric Corporation, Tokyo (JP)

(72) Inventors: Shota Morikawa, Tokyo (JP); Tomoya Fukui, Tokyo (JP); Koyuki Nagashima, Tokyo (JP); Takashi Ikeda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 650 days.

(21) Appl. No.: 17/292,450

(22) PCT Filed: Dec. 26, 2018

(86) PCT No.: PCT/JP2018/047789
§ 371 (c)(1),
(2) Date: May 10, 2021

(87) PCT Pub. No.: WO2020/136750
PCT Pub. Date: Jul. 2, 2020

(65) Prior Publication Data

US 2021/0324874 A1 Oct. 21, 2021

(51) Int. Cl.
*F04D 29/38* (2006.01)
*F04D 29/32* (2006.01)
*F04D 29/52* (2006.01)

(52) U.S. Cl.
CPC ..... *F04D 29/384* (2013.01); *F04D 29/325* (2013.01); *F04D 29/522* (2013.01)

(58) Field of Classification Search
CPC .... F04D 29/384; F04D 29/325; F04D 29/522; F24F 1/0029; F24F 1/38; F24F 1/50
See application file for complete search history.

(56) References Cited

U.S. PATENT DOCUMENTS

2018/0087439 A1 3/2018 Yamazaki
2019/0048890 A1 2/2019 Honma et al.

FOREIGN PATENT DOCUMENTS

CN 106438470 A 2/2017
JP 2003-148395 A 5/2003
(Continued)

OTHER PUBLICATIONS

Machine Translation of WO2009128299A1 Pdf File Name: "WO2009128299A1_Machine_Translation.pdf".*
(Continued)

*Primary Examiner* — Grant Moubry
*Assistant Examiner* — Ruben Picon-Feliciano
(74) *Attorney, Agent, or Firm* — XSENSUS LLP

(57) ABSTRACT

An impeller includes a boss provided on a rotation axis and a blade provided on an outer circumferential side of the boss. The blade has a radially middle portion that is located midway between an outer circumferential edge and an inner circumferential edge in a radial direction of the blade from the rotation axis. A span-direction section of part of the blade that adjoins the leading edge is shaped such that part of a suction side of the blade that is located in an area between the radially middle portion and the outer circumferential edge is concave, and a span-direction section of part of the blade that adjoins the trailing edge is shaped such that part of the suction side of the blade that is located in the area between the radially middle portion and the outer circumferential edge is convex.

9 Claims, 8 Drawing Sheets

(56) References Cited

FOREIGN PATENT DOCUMENTS

| | | | | | |
|---|---|---|---|---|---|
| JP | 2005-105865 | A | | 4/2005 | |
| JP | 2011-179330 | A | | 9/2011 | |
| JP | 2014-66204 | A | | 4/2014 | |
| JP | 2015-31238 | A | | 2/2015 | |
| JP | 2018-53822 | A | | 4/2018 | |
| WO | WO-2009128299 | A1 | * | 10/2009 | ..... F04D 29/281 |
| WO | 2016/181463 | A1 | | 11/2016 | |
| WO | 2017/154246 | A1 | | 9/2017 | |

OTHER PUBLICATIONS

Office Action issued Jun. 26, 2023 in corresponding Chinese Patent Application No. 201880100082.3 and machine English translation thereof, 8 pages.

1 Office Action issued Sep. 5, 2022 in Chinese Patent Application No. 201880100082.3, 11 pages.

International Search Report and Written Opinion mailed on Mar. 26, 2019 received for PCT Application PCT/JP2018/047789, Filed on Dec. 26, 2018, 10 pages including English Translation.

* cited by examiner

IMPELLER, FAN, AND AIR-CONDITIONING APPARATUS

CROSS-REFERENCE TO RELATED APPLICATION

The present application is based on PCT filing PCT/JP2018/047789, filed Dec. 26, 2018, the entire contents of which are incorporated herein by reference.

TECHNICAL FIELD

The present disclosure relates to an impeller that includes a boss and blades provided at an outer periphery of the boss, a fan that includes the impeller, and an air-conditioning apparatus that includes the impeller.

BACKGROUND ART

Patent Literature 1 describes an impeller including a hub located at the center of rotation of the impeller and a plurality of blades disposed around the hub. With respect to each of the blades, a section of the blade in the radial direction thereof is shaped such that part of the blade that adjoins an outer periphery of the blade is more concave toward a suction side than part of the blade that is located in the vicinity of the center of the blade in the radial direction, and part of the blade that adjoins the hub is more convex toward the suction side than the part of the blade that is located in the vicinity of the center of the blade in the radial direction.

CITATION LIST

Patent Literature

Patent Literature 1: Japanese Unexamined Patent Application Publication No. 2011-179330

SUMMARY OF INVENTION

Technical Problem

In the impeller described in Patent Literature 1, because of such a concave shape as described above, generation of blade tip vortices is promoted at part of a suction surface of each blade that is located in the vicinity of the outer periphery of the blade. Thus, in the impeller of Patent Literature 1, the efficiency of a fan can be improved.

The amount of work by the part of the blade that adjoins the outer periphery of the blade is larger than that on the part of the blade that adjoins the hub. Thus, the amount of work by the part that adjoins the outer periphery accounts for most of the amount of work by the entire blade. In the impeller of Patent Literature 1, since the sectional shape of the part of the blade in the radial direction that adjoins the outer periphery is concave toward the suction side, the load on the part of the blade that adjoins the outer periphery is small. As a result, in the impeller of in Patent Literature 1, the amount of work by the entire blade is reduced, and the static pressure of air cannot be sufficiently raised.

The present disclosure is applied to solve the above problem, and relates to an impeller, a fan, and an air-conditioning apparatus that can achieve a high efficiency and further increase the static pressure of air.

Solution to Problem

An impeller according to an embodiment of the present disclosure includes a boss provided on a rotation axis, and a blade provided on an outer circumferential side of the boss. The blade has a leading edge that is a front one of edges of the blade in a rotation direction of the blade, a trailing edge that is a rear one of the edges of the blade in the rotation direction, an outer circumferential edge that is an outer circumferential one of the edges of the blade, an inner circumferential edge that is an inner circumferential one of the edges of the blade, and a radially middle portion that is located midway between the outer circumferential edge and the inner circumferential edge in a radial direction of the blade from the rotation axis. Where at cylindrical sections of the blade that are located around the rotation axis, a line connecting points that are located from the inner circumferential edge to the outer circumferential edge such that at each of the cylindrical sections, a ratio between a distance from the leading edge to an associated one of the points and a distance from the trailing edge to the associated point is equal to those at the others of the cylindrical sections is a span line, and a section of the blade that is taken along the span line and in parallel with the rotation axis is a span-direction section, a span-direction section of part of the blade that adjoins the leading edge is shaped such that part of a suction side of the blade that is located in an area between the radially middle portion and the outer circumferential edge is concave, and a span-direction section of part of the blade that adjoins the trailing edge is shaped such that part of the suction side of the blade that is located in the area between the radially middle portion and the outer circumferential edge is convex.

A fan according to another embodiment of the present disclosure includes a casing having a bell mouth and the impeller according to the above embodiment that is located inward of the bell mouth.

An air-conditioning apparatus according to still another embodiment of the present disclosure includes the impeller according to the above embodiment of the present disclosure, and a heat exchanger that causes heat exchange to be performed between air supplied by the impeller and refrigerant that flows in the heat exchanger.

Advantageous Effects of Invention

According to the embodiment of the present disclosure, at part of the blade that adjoins the leading edge, the flow of air is not easily one-sided toward the outer circumferential edge, and generation of blade tip vortices can be promoted. In addition, at part of the blade that adjoins the trailing edge, it is possible to reduce leakage of air at the outer circumferential edge and to thus increase the amount of work by the blade. Therefore, it is possible to obtain an impeller that can achieve a high efficiency and further increase the static pressure of air.

DESCRIPTION OF EMBODIMENTS

Embodiment 1

Figure 1:
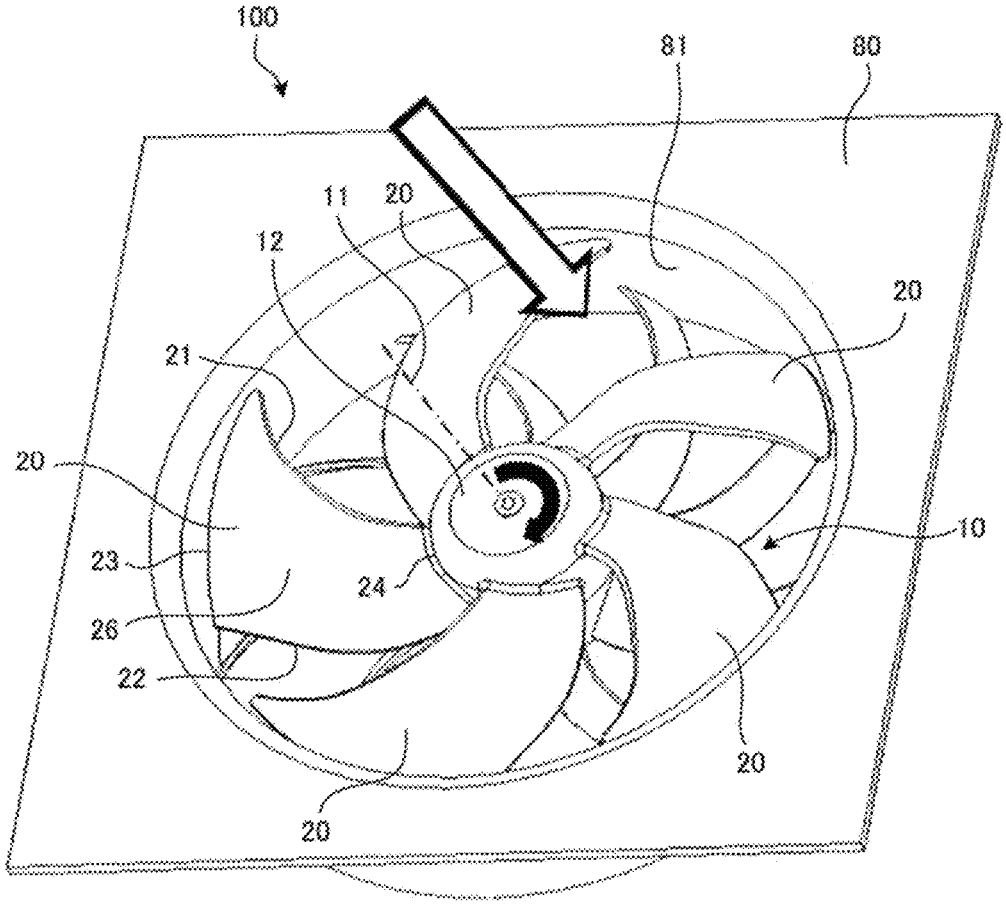
FIG. 1 is a perspective view illustrating the configuration of a fan 100 according to Embodiment 1 of the present disclosure.

An impeller according to Embodiment 1 of the present disclosure and a fan including the impeller will be described. FIG. 1 is a perspective view illustrating a configuration of a fan 100 according to Embodiment 1. FIG. 1 illustrates the configuration of the fan 100 as viewed from a suction side of the fan 100, that is, a position close to suction surfaces 26 of blades 20. In FIG. 1 and figures to be referred to later, black thick arrows indicate a rotation direction of an impeller 10, that is, the rotation direction of a boss 12 and the blades 20, each of which is part of the impeller 10. In addition, in FIG. 1 and figures to be described later, white thick arrows indicate an overall airflow direction during rotation of the impeller 10. The fan 100 according to Embodiment 1 is an axial fan that sends air in a direction along a rotation axis 11.

As illustrated in FIG. 1, the fan 100 includes a casing 80 and the impeller 10. The casing 80 has a bell mouth 81 that is substantially cylindrical. The impeller 10 is provided inward of the bell mouth 81. The impeller 10 is also provided rotatable around the rotation axis 11. The fan 100 includes a drive unit (not illustrated) such as a motor that rotates the impeller 10.

Figure 2:
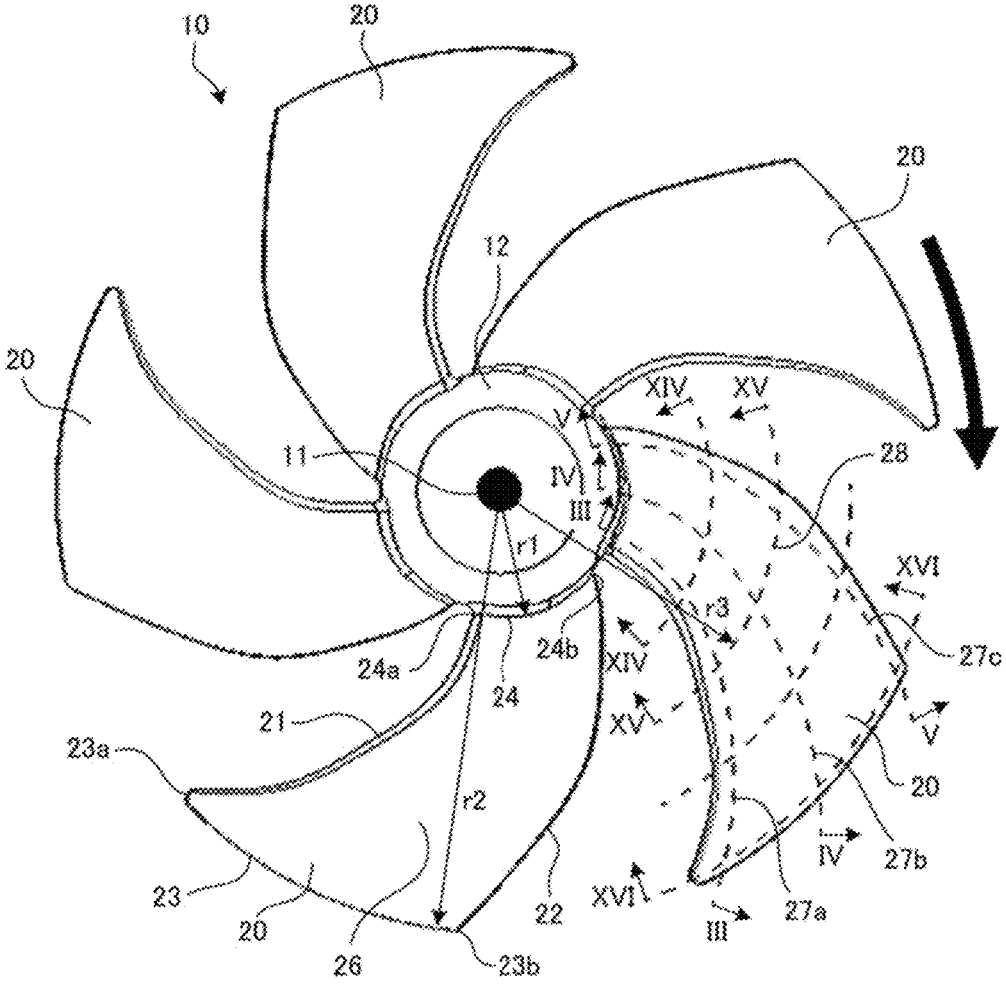
FIG. 2 is a view of an impeller 10 according to Embodiment 1 of the present disclosure that is projected on a plane perpendicular to a rotation axis 11.

FIG. 2 is a view of the impeller 10 according to Embodiment 1 that is projected on a plane perpendicular to the rotation axis 11. FIG. 2 illustrates the configuration of the impeller 10 as viewed from a position closer to the suction surfaces 26 of the blades 20. As illustrated in FIG. 2, the impeller 10 includes the boss 12, which is located on the rotation axis 11, and the plurality of blades 20, which are located on an outer circumferential side of the boss 12. The boss 12 has a substantially cylindrical shape. To a central portion of the boss 12, a drive shaft (not illustrated) included in the drive unit is connected. The boss 12 is rotated around the rotation axis 11 by a rotational driving force transmitted from the actuator via the drive shaft.

The blades 20 are disposed on the outer circumferential side of the boss 12 at regular angular intervals. The blades 20 project substantially radially from an outer circumferential wall of the boss 12. To be more specific, the blades 20 project outwardly from the outer circumferential wall of the boss 12 such that the blades are inclined forward in the rotation direction of the impeller 10 relative to respective radial directions from the rotation axis 11. Although FIG. 2 illustrates the impeller 10 including five blades 20, the number of the blades 20 of the impeller 10 is not limited to five.

The blades 20 each have a leading edge 21, a trailing edge 22, an outer circumferential edge 23, and an inner circumferential edge 24. The leading edge 21 is a front one of edges of the blade 20 in the rotation direction. The trailing edge 22 is a rear one of the edges of the blade 20 in the rotation direction. The outer circumferential edge 23 is an outer circumferential one of the edges of the blade 20. The inner circumferential edge 24 is an inner circumferential one of the edges of the blade 20. The inner circumferential edge 24 is shaped along the outer circumferential wall of the boss 12, and is connected to the outer circumferential wall.

The outer circumferential edge 23 and the leading edge 21 are adjacent to each other via an outer peripheral front end 23*a*. The outer circumferential edge 23 and the trailing edge 22 are adjacent to each other via an outer peripheral rear end 23*b*. The inner circumferential edge 24 and the leading edge 21 are adjacent to each other via an inner peripheral front end 24*a*. The inner circumferential edge 24 and the trailing edge 22 are adjacent to each other via an inner peripheral rear end 24*b*. The outer peripheral front end 23*a* is located in front of the inner peripheral front end 24*a* in the rotation direction of the impeller 10. The leading edge 21 is formed into a concave shape in the entire area between the outer peripheral front end 23*a* and the inner peripheral front end 24*a*, as viewed along the rotation axis 11. The outer peripheral rear end 23*b* is located in front of the inner peripheral rear end 24*b* in the rotation direction of the impeller 10. The trailing edge 22 is formed into a convex shape in the entire area between the outer peripheral rear end 23*b* and the inner peripheral rear end 24*b*, as viewed along the rotation axis 11.

In addition, each of the blades 20 has a radially middle portion 28. The radially middle portion 28 is located on an imaginary circle located midway between the inner circumferential edge 24 and the outer circumferential edge 23 in the radial direction of the blade 20 with respect to the rotation axis 11. Where r1 is the distance between the rotation axis 11 ad the inner circumferential edge 24, r2 is the distance between the rotation axis 11 and the outer circumferential edge 23, and r3 is the distance between the rotation axis 11 and the radially middle portion 28, $r3=(r1+r2)/2$ is satisfied.

In addition, each of the blades 20 has a pressure surface 25 (see, for example, FIG. 3) and the suction surface 26. The pressure surface 25 is a front one of the two surfaces of the blade 20 in the rotation direction. The pressure surface 25 pushes air during rotation of the blade 20. The suction surface 26 is a rear one of the two surfaces of the blade 20 in the rotation direction, and is the reverse side of the pressure surface 25. FIGS. 1 and 2 illustrate the configuration of the fan 100 and the configuration of the impeller 10, respectively, as viewed from positions closer to the suction surfaces 26. Thus, FIGS. 1 and 2 do not illustrate the pressure surfaces 25.

The blades 20 are rotated together with the boss 12, around the rotation axis 11. When the blades 20 are rotated, as indicated by a thick outlined arrow in FIG. 1, air is sucked into the fan 100, along the rotation axis 11, from a side located above the plane of the drawing. The air sucked into the fan 100 is blown from the fan 100, along the rotation axis 11, toward the opposite side of the side located above the plane of the drawing.

Figure 3:
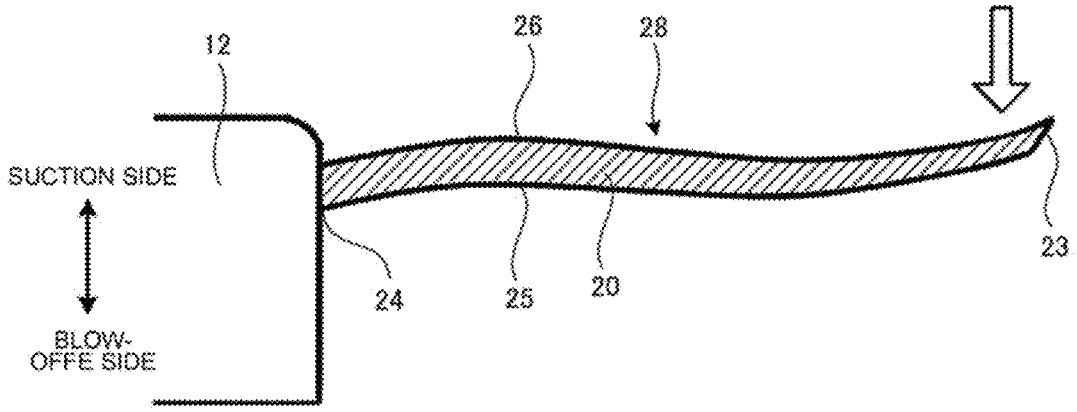
FIG. 3 is a sectional view that is taken along line III-III in FIG. 2.
Figure 4:
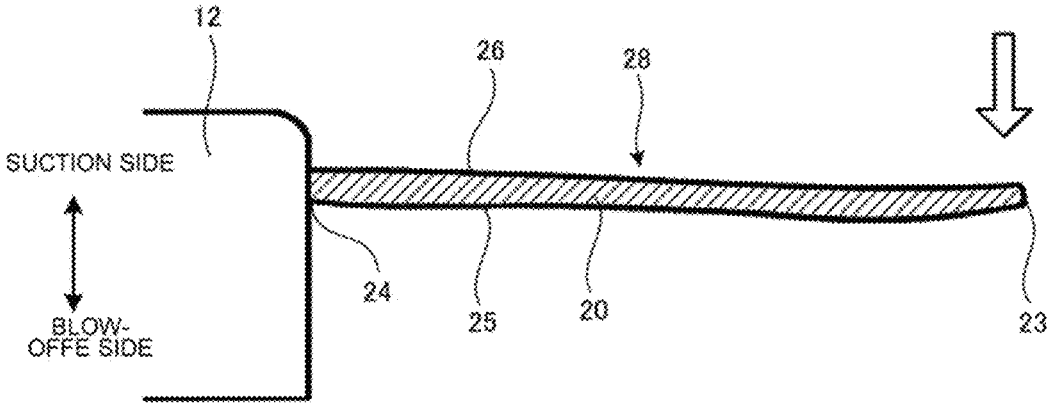
FIG. 4 is a sectional view that is taken along line IV-IV in FIG. 2.
Figure 5:
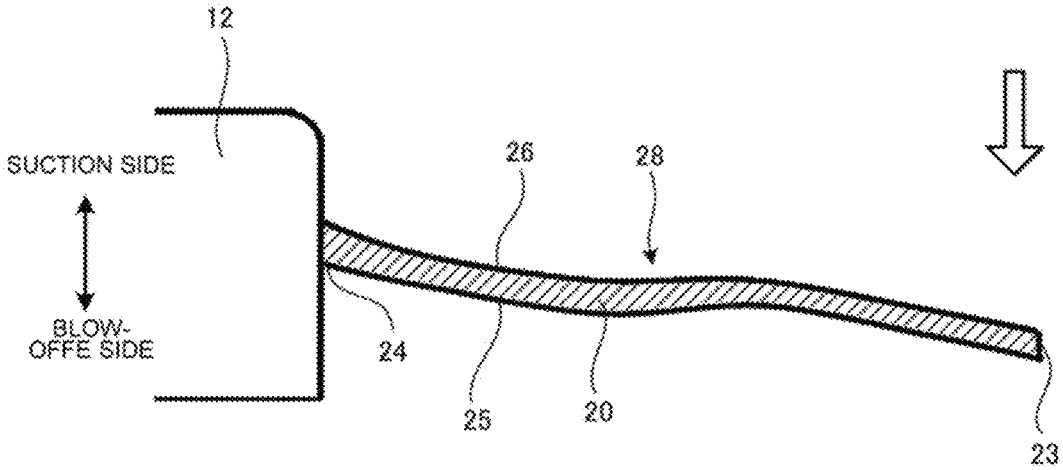
FIG. 5 is a sectional view that is taken along line V-V in FIG. 2.

FIG. 3 is a sectional view that is taken along line III-III in FIG. 2. FIG. 4 is a sectional view that is taken line IV-IV in FIG. 2. FIG. 5 is a sectional view that is taken line V-V in FIG. 2. In each of FIGS. 3, 4, and 5, the upward/downward direction is the direction along the rotation axis 11, the upper side is the suction side, and the lower side is the blow-off side.

It is assumed that at each of cylindrical sections of the blade 20 that are located around the rotation axis 11, a line that connects the following points and extends from the inner circumferential edge 24 to the outer circumferential edge 23 will be referred to as "span line". The points are located from the inner circumferential edge 24 to the outer circumferential edge 23 such that at each of the cylindrical sections, the ratio between the distance from the leading edge 21 to an associated one of the points and the distance from the trailing edge 22 to the associated point is equal to each of those at the other cylindrical sections. The distances from the leading edge 21 and the trailing edge 22 to the points are measured, for example, along curved lines on the cylindrical sections of the blade 20. Furthermore, a direction from the inner circumferential edge 24 toward the outer circumferential edge 23 along the span line will be referred to as "span direction". In addition, a section of the blade 20 that is taken in parallel with the rotation axis 11 and along the span line will be referred as "span-direction section". The section as illustrated in FIG. 3 is a span-direction section of the blade 20 that is taken along a span line 27*a*. The section as illustrated in FIG. 4 is a span-direction section of the blade 20 that is taken along a span line 27*b*. The section as illustrated in FIG. 5 is a span-direction section of the blade 20 that is taken along a span line 27*c*. The span line 27*b* is a span line that extends through midpoints between the leading edge 21 and the trailing edge 22 at cylindrical sections of the blade 2. That is, at the cylindrical sections of the blade 20 that are located around the rotation axis 1, the distance between the leading edge 21 and the span line 27*b* and the distance between the trailing edge 22 and the span line 27*b* are equal to each other. The span line 27*a* is one of span lines located closer to the leading edge 21 than the span line 27*b*. The span line 27*c* is one of span lines located closer to the trailing edge 22 than the span line 27*b*.

Where L is the length from the inner circumferential edge 24 to the outer circumferential edge 23 along the span line, the length from the inner circumferential edge 24 to the radially middle portion 28 along the span line is not necessarily 0.5 L, but falls within the range approximately 0.4 to 0.6 L.

As illustrated in FIG. 3, the span-direction section of part of the blade 20 that adjoins the leading edge 21 has an inverted S-shape. For example, in the entire area between the radially middle portion 28 and the outer circumferential edge 23, the suction surface 26, that is, the suction side, is concave. That is, in the part of the blade 20 that adjoins the leading edge 21, the area between the radially middle portion 28 and the outer circumferential edge 23 is curved such that the suction side is concave and the blow-off side is convex.

By contrast, as illustrated in FIG. 5, the span-direction section of part of the blade 20 that adjoins the trailing edge 22 has an S-shape in which the concave and convex of the section as illustrated in FIG. 3 are inverted. For example, in the entire area between the radially middle portion 28 and the outer circumferential edge 23, the suction side is convex. That is, in the part of the blade 20 that adjoins the trailing edge 22, the area between the radially middle portion 28 and the outer circumferential edge 23 is curved such that the suction side is convex and the blow-off side is concave.

As illustrated in FIG. 4, the span-direction section of part of the blade 20 that is located midway between the leading edge 21 and the trailing edge 22 is linearly shaped in a direction substantially perpendicular to the rotation axis 11.

As illustrated in FIGS. 3 and 5, in the area between the radially middle portion 28 and the outer circumferential edge 23, the span-direction section of the part of the blade 20 that adjoins the leading edge 21 is curved such that the suction side is concave, whereas the span-direction section of the part of the blade 20 that adjoins the trailing edge 22 is curved such that the suction side is convex. Thus, in the area between the radially middle portion 28 and the outer circumferential edge 23, at a position in the area from the leading edge 21 to the trailing edge 22, a first inflection point 41 (see FIG. 8) is located where the shape of the suction side changes from a concave shape to a convex shape. In Embodiment 1, the first inflection point 41 is located on the span line 27*b* that is located midway between the leading edge 21 and the trailing edge 22. However, as described later, the position of the first inflection point 41 is not limited to the position on the span line 27*b*.

Figure 6:
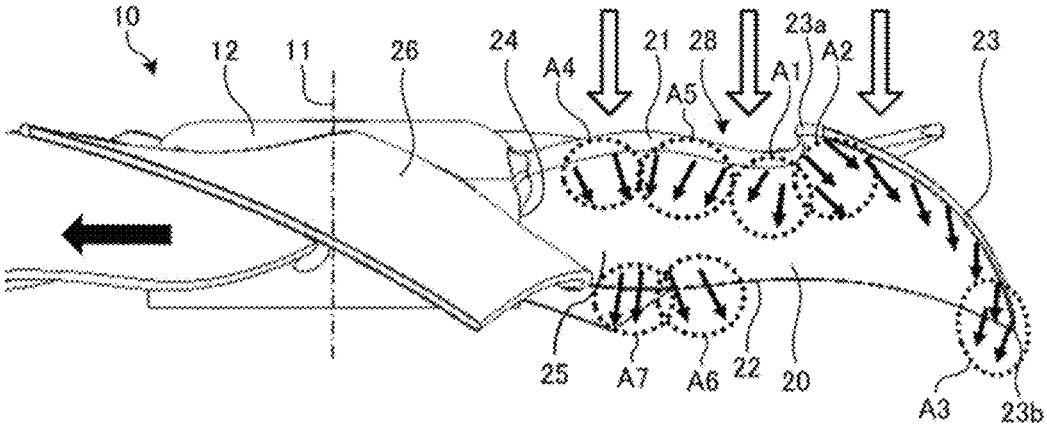
FIG. 6 illustrates a configuration of the impeller 10 according to Embodiment 1 of the present disclosure as viewed in a direction perpendicular to the rotation axis 11.
Figure 7:
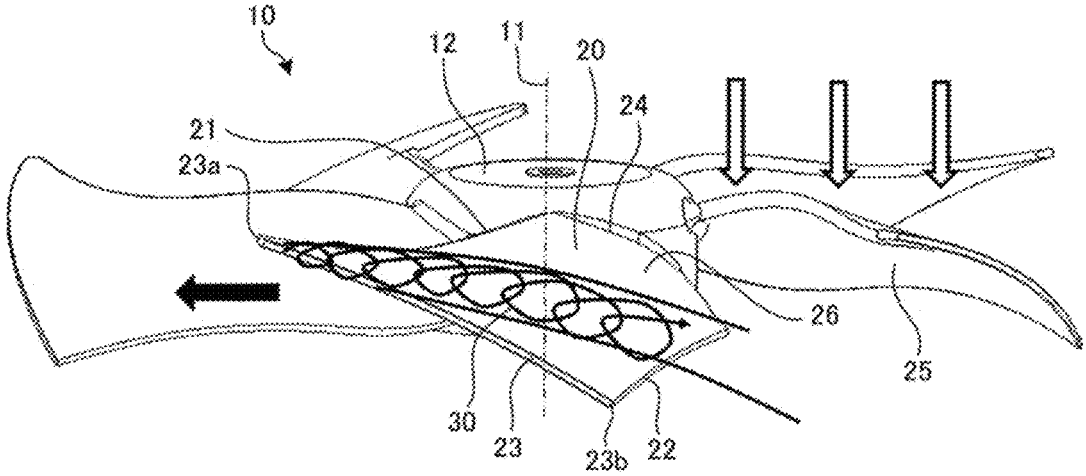
FIG. 7 illustrates an example of blade tip vortices 30 generated at the impeller 10 according to Embodiment 1 of the present disclosure.

FIG. 6 illustrates the configuration of the impeller 10 according to Embodiment 1 as viewed in a direction perpendicular to the rotation axis 11. FIG. 7 illustrates an example of blade tip vortices 30 generated at the impeller 10 according to Embodiment 1. In each of FIGS. 6 and 7, the upward/downward direction is the direction along the rotation axis 11, the upper side is the suction side, and the lower side is the blow-off side. In FIG. 6, arrows indicate the orientations of parts of the pressure surface 25 of the blade 20, that is, the normal directions to the parts of the pressure surface 25 of the blade 20. It is known that at a common axial fan, energy loss areas that are called blade tip vortices are generated at an outer circumferential edge of a blade, since an air current flows around the outer circumferential edge because of the difference in pressure between a pressure surface and a suction surface.

As illustrated in FIG. 6, in Embodiment 1, at the leading edge 21 of the blade 20, in an area A1 that is located between the radially middle portion 28 and the outer circumferential edge 23 and closer to the radially middle portion 28, the pressure surface 25 faces an inner circumferential side. When the impeller 10 is rotated, air that has flowed to the pressure surface 25 of part of the leading edge 21 that adjoins the inner circumferential edge 24 is made to flow toward the outer circumferential edge 23 by a centrifugal force. In the area A1, the pressure surface 25 reduces the flow of air toward the outer circumferential edge 23 and guides the air toward the trailing edge 22. Thus, the flow of air at the pressure surface 25 is not easily one-sided toward the outer circumferential edge 23. As a result, it is possible to reduce a rise in the pressure at part of the pressure surface 25 that adjoins the outer circumferential edge 23 and to reduce an increase in the difference in pressure between the pressure surface 25 and the suction surface 26.

in an area A2 located close to part of the leading edge 21 that adjoins the outer circumferential edge 23, that is, located close to the outer peripheral front end 23*a*, the pressure surface 25 faces the outer circumferential side. Thus, as illustrated in FIG. 7, generation of blade tip vortices 30 is promoted in the vicinity of the outer peripheral front end 23*a*. It is therefore possible to reduce generation of a turbulent flow that will be caused by collapse of the blade tip vortices 30 and thus reduce loss. Because of provision of the above configuration, it is possible to reduce an increase and growth of blade tip vortices 30 and achieve a high efficiency of the fan 100.

Furthermore, in an area A3 located close to part of the trailing edge 22 that adjoins the outer circumferential edge 23, that is, located in the vicinity of the outer peripheral rear end 23*b*, the pressure surface 25 faces an inner circumferential side. Thus, air guided from part of the leading edge 21 that adjoins the inner circumferential edge 24, toward the trailing edge 22, is guided in a blowing direction at the outer peripheral rear end 23*b* along the outer circumferential edge 23. As a result, it is possible to raise the static pressure of air also in the vicinity of the outer peripheral rear end 23*b*, while reducing leakage of air at part of the outer circumferential edge 23 that adjoins the trailing edge 22.

In the impeller described in Patent Literature 1, part of the blade that is closer to the outer peripheral side than the vicinity of the center in the radial direction is concave toward the suction side throughout the entire area from the leading edge to the trailing edge in the circumferential direction. Therefore, in the case where part of the suction side that is most concave is a concave portion, generation of blade tip vortices is promoted in the vicinity of the outer circumferential edge that is located closer to the outer circumferential side than the concave portion, but it cannot be expected that the static pressure of air will be raised. Thus, this blade works only in an area located closer to the inner circumferential side than the concave portion. As a result, the height of the blade in the axial direction needs to be relatively great in order to ensure a certain amount of rise in pressure at the area closer to the inner circumferential side than the concave portion.

In general, as is often the case, in an air passage of an air-conditioning apparatus, the pressure loss rises to a high level due to the shape of the air passage. Thus, the static pressure of air needs to be sufficiently raised, especially in a fan mounted in an air-conditioning apparatus. When the amount of rise in pressure is small, the rotation speed of the fan needs to be increased to achieve a predetermined air volume, and as a result, a larger amount of noise can be made; that is, another problem can arise.

By contrast, in Embodiment 1, it is possible to raise the static pressure of air t also in the vicinity of the outer peripheral rear end 23*b*, and therefore possible to achieve a high efficiency and to further greatly raise the static pressure of air, while reducing an increase in the height of each blade 20 in the axial direction. As a result, even in the case where the fan 100 is mounted in an air-conditioning apparatus, it is possible to reduce noise.

Figure 8:
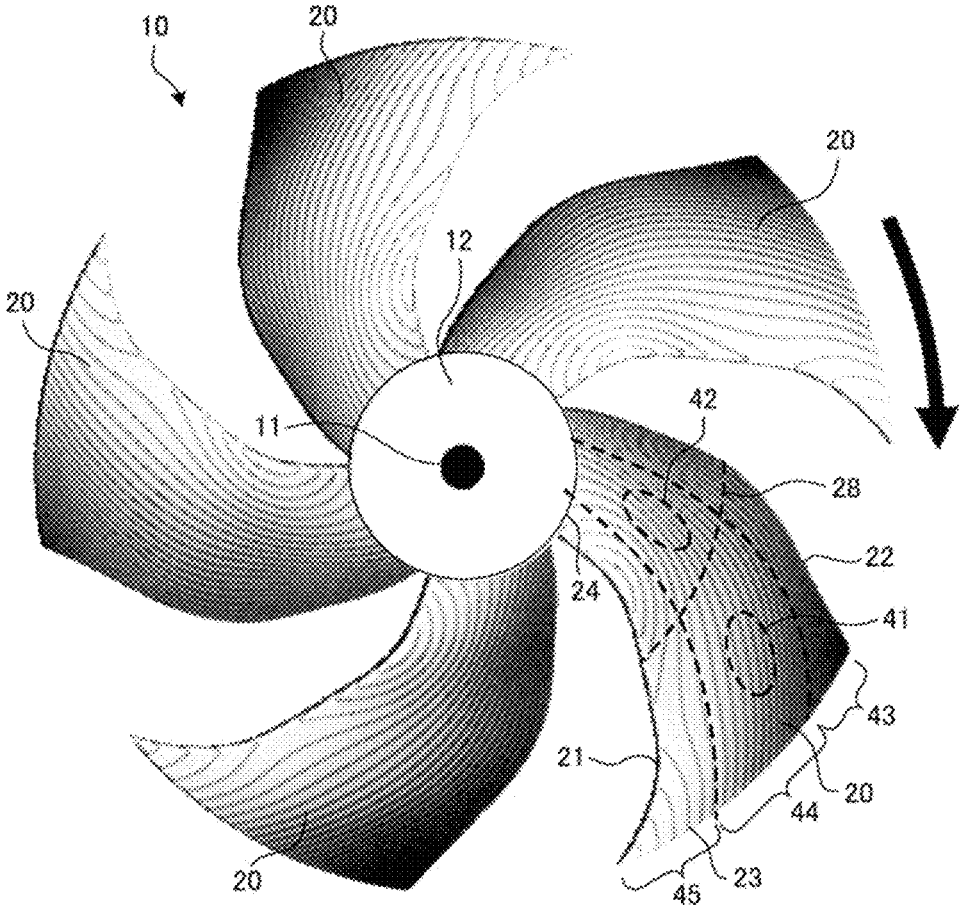
FIG. 8 illustrates the configuration of the impeller 10 according to Embodiment 1 of the present disclosure as viewed in a direction parallel to the rotation axis 11.

FIG. 8 illustrates the configuration of the impeller 10 according to Embodiment 1 as viewed in a direction parallel to the rotation axis 11. Referring to FIG. 8, contour lines are drawn with reference to the heights of planes perpendicular to the rotation axis 11. As illustrated in FIG. 8, the first inflection point 41 is located in the area between the radially middle portion 28 and the outer circumferential edge 23. The first inflection point 41 is a point where the curved shape of the suction side changes from a concave shape to a convex shape in a direction from the leading edge 21 toward the trailing edge 22.

Figure 9:
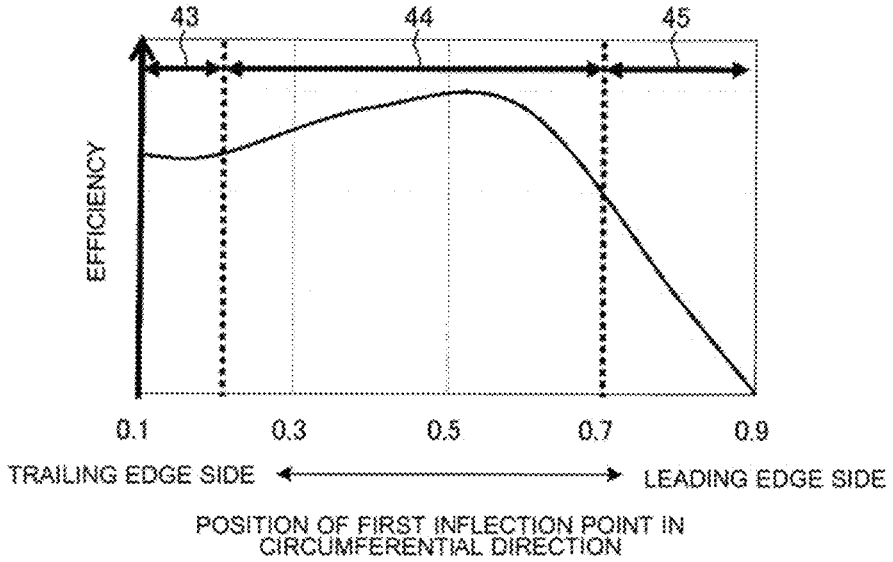
FIG. 9 is a graph indicating the relationship between the position of a first inflection point 41 in a circumferential direction and the efficiency of the impeller 10 according to Embodiment 1 of the present disclosure.
Figure 10:
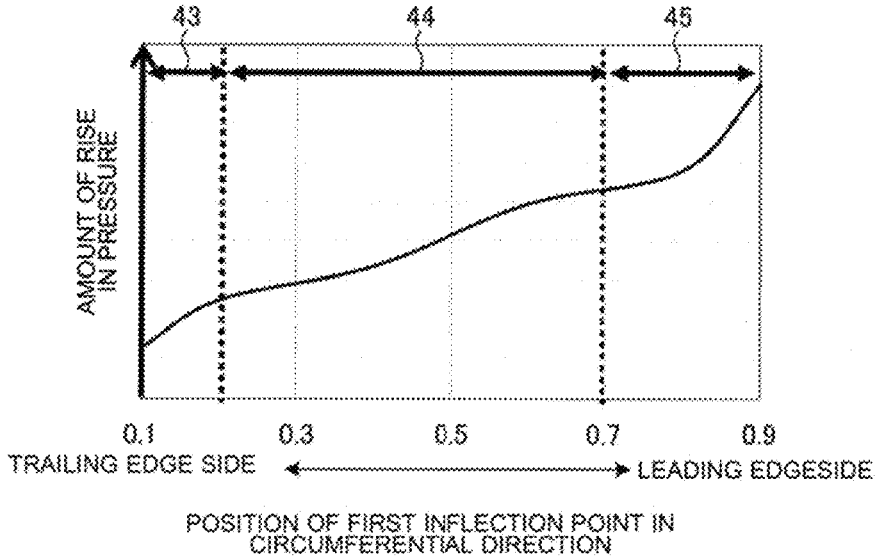
FIG. 10 is a graph indicating the relationship between the position of the first inflection point 41 in the circumferential direction and the amount of rise in pressure at the impeller 10 according to Embodiment 1 of the present disclosure.

FIG. 9 is a graph indicating the relationship between the position of the first inflection point 41 in the circumferential direction and the efficiency of the impeller 10 according to Embodiment 1. The horizontal axis represents the position of the first inflection point 41 in the circumferential direction, and the vertical axis represents the efficiency of the impeller 10. FIG. 10 is a graph indicating the relationship between the position of the first inflection point 41 in the circumferential direction and the amount of rise in pressure at the impeller 10 according to Embodiment 1. The horizontal axis represents the position of the first inflection point 41 in the circumferential direction, and the vertical axis represents the amount of rise in pressure at the impeller 10. It is assumed that at a cylindrical section of the blade 20 that is located around the rotation axis 11, 0 is the position of the trailing edge 22 in the circumferential direction, and 1 is the position of the leading edge 21 in the circumferential direction.

As illustrated in FIGS. 9 and 10, in the case where the first inflection point 41 is located at a position in the circumferential direction that falls within the range of 0.2 to 0.7, that is, located in a circumferentially middle area 44 as illustrated in FIG. 8, the efficiency of the impeller 10 rises, and the amount of rise in pressure at the impeller 10 sufficiently increases. This is because in the case where the first inflection point 41 is located in the circumferentially middle area 44, the following are achieved at the same time: a higher efficiency is achieved because of promotion of generation of blade tip vortices at the part of the outer circumferential edge 23 that adjoins the leading edge 21; and the amount of rise in the pressure is increased by reducing leakage of air at the part of the outer circumferential edge 23 that adjoins the trailing edge.

On the other hand, when the first inflection point 41 is located at a position in the circumferential direction that corresponds to more than 0.7, that is, in a leading edge area 45 as illustrated in FIG. 8, the amount of rise in pressure at the impeller 10 increases, but the efficiency of the impeller 10 is reduced. This is because in the case where the first inflection point 41 is located in the leading edge area 45, generation of blade tip vortices cannot be sufficiently promoted at the outer circumferential edge 23, and the loss is increased because of leakage of large vortices that occurs in the area that adjoins the trailing edge 22 and where the difference in pressure between the pressure surface 25 and the suction surface 26 is great.

Furthermore, when the first inflection point 41 is located at a position in the circumferential direction that corresponds to less than 0.2, that is, in a trailing edge area 43 as illustrated in FIG. 8, the efficiency of the impeller 10 is increased, but the amount of rise in pressure at the impeller 10 is reduced, as in the impeller disclosed in Patent Literature 1. This is because when the first inflection point 41 is located in the trailing edge area 43, the amount of leakage of air at part of the outer circumferential edge 23 that adjoins the trailing edge 22 increases, as a result of which the amount of rise in pressure cannot be sufficiently ensured in the vicinity of the outer peripheral rear end 23*b*.

Figure 11:
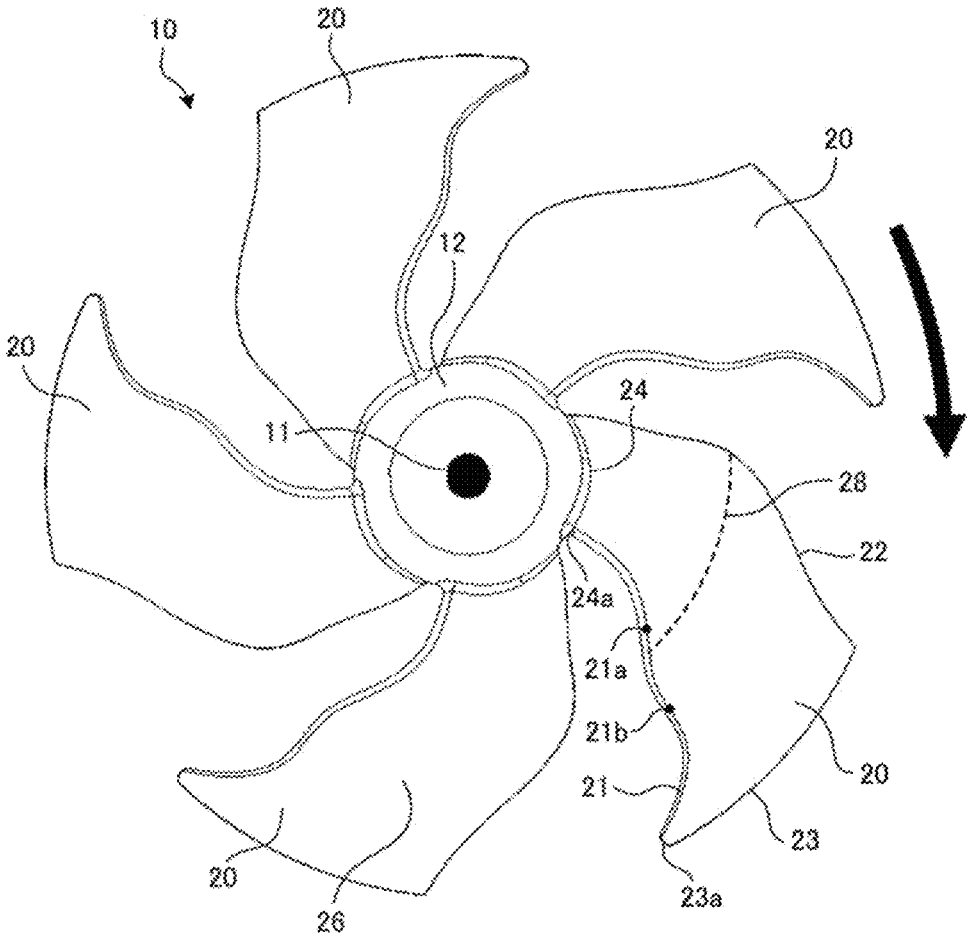
FIG. 11 is a view of the impeller 10 according to a modification of Embodiment 1 of the present disclosure that is projected on the plane perpendicular to the rotation axis 11.
Figure 12:
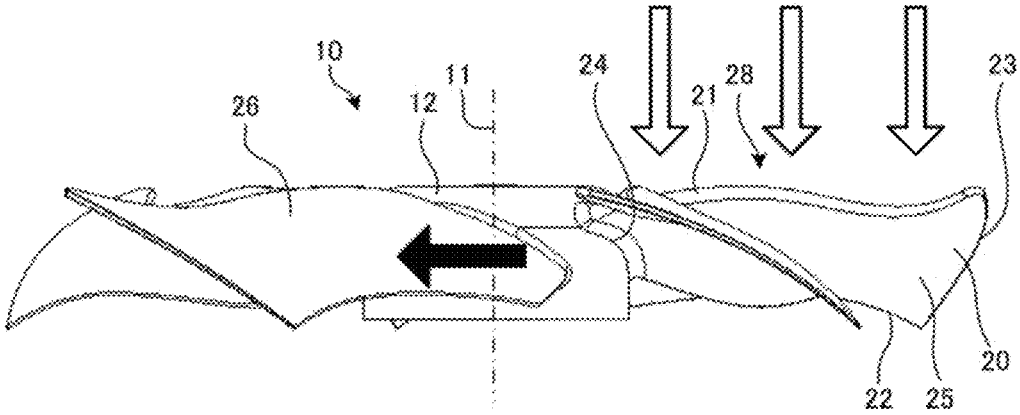
FIG. 12 is a diagram illustrating the configuration of the impeller 10 according to the modification of Embodiment 1 of the present disclosure when viewed in the direction perpendicular to the rotation axis 11.
Figure 13:
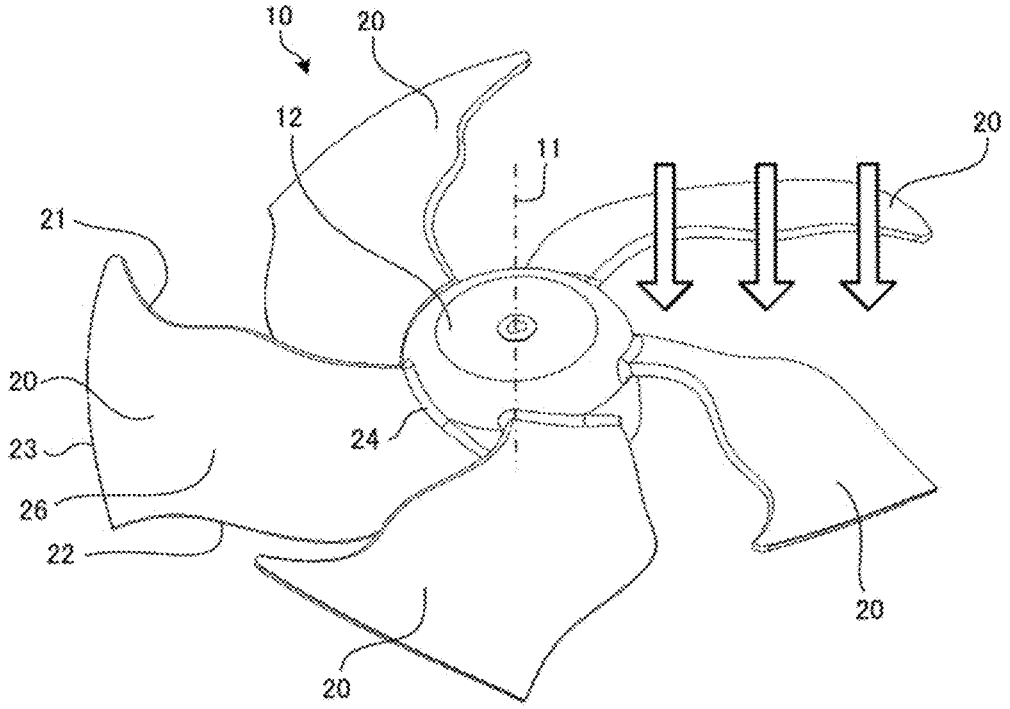
FIG. 13 is a perspective view of the configuration of the impeller 10 according to the modification of Embodiment 1 of the present disclosure.

FIG. 11 is a view of the impeller 10 according to a modification of Embodiment 1 that is projected on the plane perpendicular to the rotation axis 11. FIG. 12 illustrates a configuration of the impeller 10 according to the modification of Embodiment 1 as viewed in the direction perpendicular to the rotation axis 11. FIG. 13 is a perspective view of the configuration of the impeller 10 according to the modification of Embodiment 1. As illustrated in FIGS. 11 to 13, in the modification, part of the leading edge 21 of each blade 20 that is located in the vicinity of the radially middle portion 28 is partially convex forward in the rotation direction. At part of the leading edge 21 that is located between the inner peripheral front end 24*a* and the radially middle portion 28, an inflection point 21*a* is located. At part of the leading edge 21 that is located between the radially middle portion 28 and the outer peripheral front end 23*a*, an inflection point 21*b* is located. Part of the leading edge 21 that is located between the inner peripheral front end 24*a* and the inflection point 21*a* is concave. Part of the leading edge 21 that is located between the inflection point 21*a* and the inflection point 21*b* is convex. Part of the leading edge 21 that is located between the inflection point 21*b* and the outer peripheral front end 23*a* is concave. The other configurations are the same as those as illustrated in FIGS. 1 to 8. In the modification, it is also possible to obtain the same advantages as in the configurations described above.

As described above, the impeller 10 according to Embodiment 1 includes the boss 12 that is provided on the rotation axis 11 and the blades 20 that are disposed on the outer circumferential side of the boss 12. Each of the blades 20 has: the leading edge 21 that is the front one of the edges of the blade 20 in the rotation direction; the trailing edge 22 that is the rear one of the edges in the rotation direction; the outer circumferential edge 23 that is the outer circumferential one of the edges; the inner circumferential edge 24 that is the inner circumferential one of the edges; and the radially middle portion 28 that is located midway between the outer circumferential edge 23 and the inner circumferential edge 24 in the radial direction of each blade 20 from the rotation axis 11. It is assumed that at cylindrical sections of the blades 20 that are located around the rotation axis 11, lines that connect the following points and extend from the inner circumferential edge 24 to the outer circumferential edge 23 will be referred to as span lines 27*a*, 27*b*, and 27*c*. Regarding each of the span lines, the above points are located from the inner circumferential edge 24 to the outer circumferential edge 23 such that at each of the cylindrical sections, the ratio between the distance from the leading edge 21 to an associate one of the points and the distance from the trailing edge 22 to the above associated point is equal to each of those at the others of the cylindrical sections. Furthermore, a section of the blade 20 that is taken in parallel with the rotation axis 11 and along the span line will be referred as a span-direction section. A span-direction section of part of the blade 20 that adjoins the leading edge 21 is shaped such that the suction side is concave between the radially middle portion 28 and the outer circumferential edge 23. A span-direction section of part of the blade 20 that adjoins the trailing edge 22 is shaped such that the suction side is convex between the radially middle portion 28 and the outer circumferential edge 23. It should be noted that the span-direction section of the part close to the leading edge 21 is a span-direction section taken along, for example, the span line 27*a*, and the span-direction section of the part close to the trailing edge 22 is a span-direction section taken along, for example, the span line 27*c*.

In the above configuration, at the part of the blade 20 that adjoins the leading edge 21, the flow of air at the pressure surface 25 is not easily one-sided toward the outer circumferential edge 23 and generation of blade tip vortexes 30 is promoted. Furthermore, at the part of the blade 20 that adjoins the trailing edge 22, it is possible to reduce leakage of air at the outer circumferential edge 23 and thus increase the amount of work by the blade 20. Therefore, according to Embodiment 1, it is possible to obtain the impeller 10 that can achieve a high efficiency and further greatly raise the static pressure of air.

Furthermore, in the impeller 10 according to Embodiment 1, the blade 20 has the first inflection point 41 at which the curved shape of the suction side changes from a concave shape to a convex shape in a direction from the leading edge 21 toward the trailing edge 22. At the cylindrical sections of the blade 20 that are located around the rotation axis 11, where 0 is the position of the trailing edge 22 in the circumferential direction, and 1 is the position of the leading edge 21 in the circumferential direction, the first inflection point 41 is located at a position in the circumferential direction that falls within the range of 0.2 to 0.7.

In the above configuration, it is possible to achieve a higher efficiency and at the same time increase the amount of rise in pressure. The higher efficiency can be achieved by promoting generation of blade tip vortices at the part of the outer circumferential edge 23 that adjoins the leading edge 21, and the amount of rise in pressure can be increased by reducing leakage of air at the part of the outer circumferential edge 23 that adjoins the trailing edge 22.

Furthermore, the fan 100 according to Embodiment 1 includes the casing 80 that is provided with the bell mouth 81, and the impeller 10 according to Embodiment 1 that is provided inward of the bell mouth 81. In this configuration, it is possible to obtain the fan 100 that can achieve a high efficiency and more greatly raise the static pressure of air.

Embodiment 2

Figure 14:
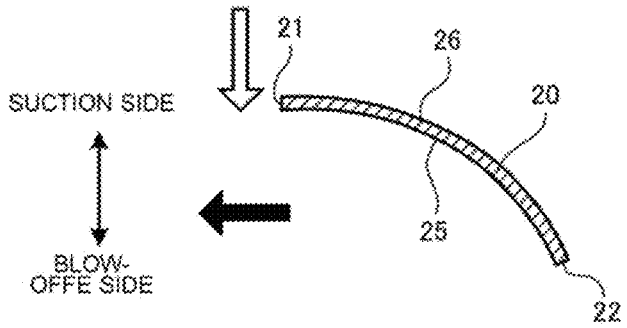
FIG. 14 is a sectional view that is taken along line XIV-XIV in FIG. 2.
Figure 15:
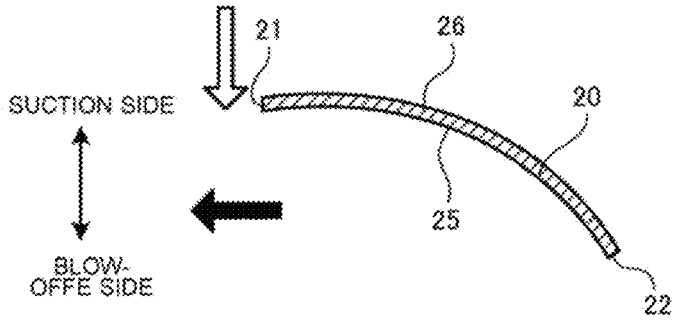
FIG. 15 is a sectional view that is taken along line XV-XV in FIG. 2.
Figure 16:
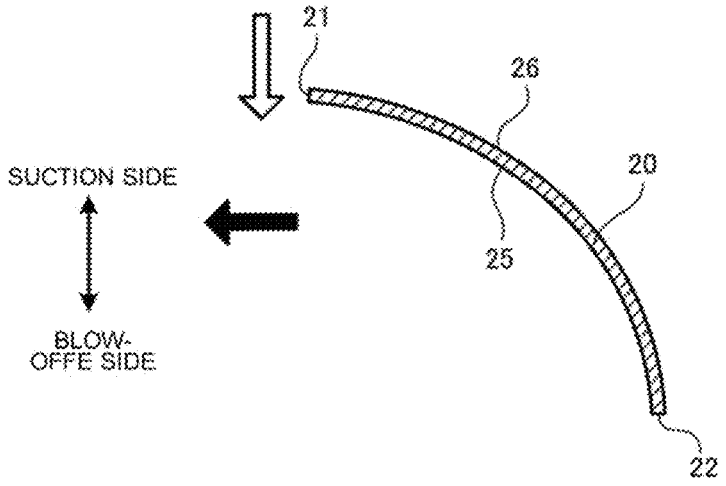
FIG. 16 is a sectional view that is taken along line XVI-XVI in FIG. 2.

An impeller according to Embodiment 2 of the present disclosure will be described. A feature of Embodiment 2 resides in the shape of each of cylindrical sections of each blade 20 that are located around the rotation axis 11. The feature of Embodiment 2 will be described with reference to FIG. 2. FIG. 14 is a sectional view that is taken along line XIV-XIV in FIG. 2. FIG. 15 is a sectional view that is taken along line XV-XV in FIG. 2. FIG. 16 is a sectional view that is taken along line XVI-XVI in FIG. 2. FIGS. 14, 15, and 16 illustrate respective cylindrical sections of the blade 20 that are located around the rotation axis 11. FIG. 15 illustrates a cylindrical section that is taken along the radially middle portion 28. FIG. 14 illustrates a cylindrical section that is taken at a location closer to the inner circumferential side than the radially middle portion 28. FIG. 16 illustrates a cylindrical section that is taken at a location closer to the outer circumferential side than the radially middle portion 28. In each of FIGS. 14, 15, and 16, the upward/downward direction is a direction along the rotation axis 11; the upper side is the suction side; and the lower side is the blow-off side. It should be noted that components that have the same functions and operations as those of Embodiment 1 will be denoted by the same reference signs, and their descriptions will thus be omitted.

The cylindrical sections as illustrated in FIGS. 14, 15, and 16 are each shaped such that the suction side is convex, and do not have an inflection point between the leading edge 21 and the trailing edge 22. That is, in each of the cylindrical sections as illustrated in FIGS. 14, 15, and 16, the entire suction side is convex. If a convex portion in which the blow-off side is convex is provided at part of a cylindrical section of the blade 20 that is close to the trailing edge 22, part of the blade 20 that is closer to the trailing edge 22 than the convex portion does not work, and the amount of rise in pressure at the impeller 10 is thus reduced. By contrast, in each of the blades 20 of Embodiment 2, at each of a cylindrical section taken along the radially middle portion 28, a cylindrical section taken at a location inward of the radially middle portion 28, and a cylindrical section taken at a location outward of the radially middle portion 28, the entire suction side is convex. It is therefore possible to increase the amount of rise in pressure at the impeller 10.

As described above, in the impeller 10 according to Embodiment 2, each of cylindrical sections of the blade 20 that are located around the rotation axis 11 is shaped such that the suction side is convex, and the cylindrical section does not have an inflection point between the leading edge 21 and the trailing edge 22. In this configuration, it is possible to increase the amount of rise in pressure at the blade 20.

Embodiment 3

An impeller according to Embodiment 3 of the present disclosure will be described. A feature of Embodiment 3 resides in the shape of part of the blade 20 that is located inward of the radially middle portion 28. The feature of Embodiment 3 will be described with reference to FIGS. 2 to 6 and 8.

As illustrated in FIG. 3, the span-direction section of part of the blade 20 that adjoins the leading edge 21 is shaped such that the suction side is convex, for example, in the entire area between the inner circumferential edge 24 and the radially middle portion 28. That is, the part of the blade 20 that adjoins the leading edge 21 is curved such that in the area between the inner circumferential edge 24 and the radially middle portion 28, the suction side is convex and the blow-off side is concave.

Furthermore, as illustrated in FIG. 5, the span-direction section of the part of the blade 20 that adjoins the trailing edge 22 is shaped such that the suction side is concave, for example, in the entire area between the inner circumferential edge 24 and the radially middle portion 28. That is, the part of the blade 20 that adjoins the trailing edge 22 is curved such that in the area between the inner circumferential edge 24 and the radially middle portion 28, the suction side is concave and the blow-off side is convex.

As illustrated in FIG. 4, the span-direction section of part of the blade 20 that is located midway between the leading edge 21 and the trailing edge 22 is linear in a direction substantially perpendicular to the rotation axis 11 in the entire area in the span direction that includes the area between the inner circumferential edge 24 and the radially middle portion 28.

In general, on an inner circumferential side of an axial fan, a centrifugal force generated by the blade 20 is small. In addition, in general, on the inner circumferential side of the axial fan, an air current collides with the boss 12, thereby generating a turbulent flow. Thus, in the turbulent flow may remain on the inner circumferential side of the axial fan.

As illustrated in FIG. 6, at the leading edge 21 of the blade 20 in Embodiment 3, at the area A close to the inner circumferential edge 24, the pressure surface 25 faces the outer circumferential side. Thus, air in the vicinity of the inner circumferential edge 24 is guided toward the outer circumferential side where the centrifugal force is relatively large. It is therefore possible to prevent a turbulent flow from remaining in the vicinity of the inner circumferential edge 24 and to thus reduce the loss.

At the leading edge 21, at an area A5 located between the inner circumferential edge 24 and the radially middle portion 28 and closer to the radially middle portion 28, the pressure surface 25 faces the inner circumferential side. Thus, part of the pressure surface 25 that is located in the area A5 can be made to face in the same direction as part of the pressure surface 25 that is located in the area A1 adjacent to the outer peripheral side. Therefore, air that has flowed to an area located inward of the radially middle portion 28 can be made to smoothly flow toward an area located outward of the radially middle portion 28.

Furthermore, at the trailing edge 22, at an area A6 located between the inner circumferential edge 24 and the radially middle portion 28 and closer to the radially middle portion 28, the pressure surface 25 faces the outer circumferential side. Thus, air guided from the leading edge 21 to the area A6 can be guided to an area closer to the outer circumferential side. Thus, the amount of rise in pressure can be further increased because of the centrifugal force.

At the trailing edge 22, an area A7 closer to the inner circumferential edge 24, the pressure surface 25 faces the inner circumferential side. At an area located downstream of the boss 12, an air current is blocked by the boss 12, and a vortex is thus generated. The vortex generated at the area downstream of the boss 12 can be a resistance that narrows an effective flow passage on the blow-off side of the blade 20. By contrast, in Embodiment 3, at the area A7, the pressure surface 25 faces the inner circumferential side, and it is therefore possible to generate an air current in the area downstream of the boss 12. As a result, it is possible to reduce generation of a vortex at the area downstream of the boss 12. In addition, since an air current is generated in the area downstream of the boss 12, a wind velocity distribution at an area downstream of the impeller 10 can be uniformized. It is therefore possible to reduce an increase in the loss.

As illustrated in FIGS. 3 and 5, at the area between the inner circumferential edge 24 and the radially middle portion 28, the span-direction section of part of the blade 20 that adjoins the leading edge 21 is curved such that the suction side is convex, and the span-direction section of part of the blade 20 that adjoins the trailing edge 22 is curved such that the suction side is concave. Thus, in the area between the inner circumferential edge 24 and the radially middle portion 28, at a position from the leading edge 21 to the trailing edge 22, a second inflection point 42 is present. The second inflection point is a point at which the curved shape of the suction side changes from a convex shape to a concave shape. In Embodiment 3, the second inflection point 42 is located on the span line 27*b* that is located midway between the leading edge 21 and the trailing edge 22. However, as described later, the position of the second inflection point 42 is not limited to the position on the span line 27*b*.

It is preferable that the second inflection point 42, as well as the first inflection point 41, be provided at a position in the circumferential direction that falls within the range of 0.2 to 0.7, that is, in the circumferentially middle area 44 as illustrated in FIG. 8. It is assumed that at each of cylindrical sections of the blade 20 that are located around the rotation axis 11, 0 is the position of the trailing edge 22 in the circumferential direction, and 1 is the position of the leading edge 21 in the circumferential direction. Since the second inflection point 42 is located in the circumferentially middle area 44, the following advantages can be both obtained: air that has flowed to the inner circumferential side of the blade 20 can be made to smoothly flow toward the outer circumferential side; and the amount of rise in pressure can be further increased by applying the centrifugal force. In addition, since the second inflection point 42 is located in the circumferentially middle area 44, it is possible to reduce generation of vortices in the area downstream of the boss 12.

As described above, in the impeller 10 according to Embodiment 3, a span-direction section of an area that adjoins the leading edge 21 is shaped such that in the area between the inner circumferential edge 24 and the radially middle portion 28, the suction side is convex. A span-direction section of an area that adjoins the trailing edge 22 is shaped such that in the area between the inner circumferential edge 24 and the radially middle portion 28, the suction side is concave.

In the above configuration, at the part of the blade 20 that adjoins the leading edge 21, air that has flowed to the area closer to the inner circumferential side than the radially middle portion 28 can be made to smoothly flow toward the area closer to the outer periphery than the radially middle portion 28. Furthermore, at the part of the blade 20 that adjoins the trailing edge 22, air guided from the leading edge 21 can be guided toward the outer circumferential side. Thus, the amount of rise in pressure can be further increased by the centrifugal force.

Furthermore, in the impeller 10 according to Embodiment 3, the blade 20 has the second inflection point 42 at which the curved shape of the suction side changes from a convex shape to a concave shape in the direction from the leading edge 21 toward the trailing edge 22. At each of cylindrical sections of the blade 20 that are located around the rotation axis 11, where 0 is the position of the trailing edge 22 in the circumferential direction, and 1 is the position of the leading edge 21 in the circumferential direction, the second inflection point 42 is provided at a position in the circumferential direction that falls within the range of 0.2 to 0.7.

In the above configuration, air that has flowed to the area closer to the inner circumferential side of the blade 20 can be made to smoothly flow toward the outer circumferential side and at the same time the amount of rise in pressure can be further increased by the centrifugal force.

In the above configuration, air that has flowed to the area closer to the inner circumferential side of the blade 20 can be made to smoothly flow toward the outer circumferential side and at the same time the amount of rise in pressure can be further increased by the centrifugal force.

Embodiment 4

Figure 17:
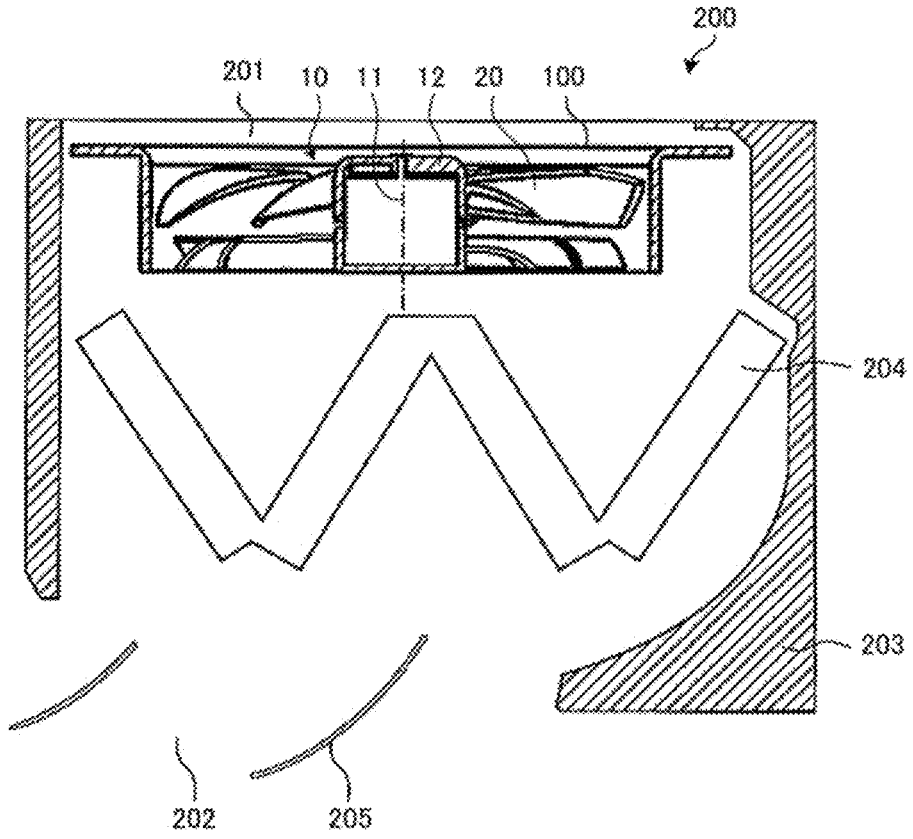
FIG. 17 is a sectional view illustrating a configuration of an air-conditioning apparatus 200 according to Embodiment 4 of the present disclosure.

An air-conditioning apparatus according to Embodiment 4 will be described. FIG. 17 is a sectional view illustrating a configuration of an air-conditioning apparatus 200 according to Embodiment 4. The left side of FIG. 17 corresponds to the front side of the air-conditioning apparatus 200. Regarding Embodiment 4, a wall-mounted indoor unit will be illustrated as an example of the air-conditioning apparatus 200.

As illustrated in FIG. 17, the air-conditioning apparatus 200 includes the impeller 10 according to any one of Embodiments 1 to 3 and the fan 100 that includes the impeller 10. In addition, the air-conditioning apparatus 200 includes a housing 203. In an upper part of the housing 203, an air inlet 201 is provided to suck indoor air into the housing 203. In a lower part of the front side of the housing 203, an air outlet 202 is provided to flow out conditioned air into an air-conditioned space. At the air outlet 202, a mechanism that controls a blowing direction of conditioned air, for example, a wind direction vane 205, is provided.

In the housing 203, the fan 100 and a heat exchanger 204 are disposed in an air passage from the air inlet 201 to the air outlet 202. The fan 100 is located downstream of the air inlet 201 and upstream of the heat exchanger 204 in the flow of air. The fan 100 or a plurality of fans 100 are disposed side by side in the longitudinal direction of the housing 203 (in a direction perpendicular to the plane of the drawing), and the number and arrangement of fans 100 depend on the rate of air that is required at the air-conditioning apparatus 200. The heat exchanger 204 causes heat exchange to be performed between indoor air and refrigerant that flows in the heat exchanger 204, thereby generating conditioned air.

When the impeller 10 of the fan 100 is rotated, indoor air is sucked into the housing 203 through the air inlet 201. When passing through the heat exchanger 204, the indoor air exchanges heat with refrigerant and is thus heated or cooled, that is, the indoor air is conditioned. The conditioned air is blown from the air outlet 202 into the air-conditioned area.

As described above, the impeller 10 achieves a higher efficiency than existing impellers. That is, the fan 100 achieves a higher efficiency than existing fans. Therefore, in the air-conditioning apparatus 200 according to Embodiment 4, the power efficiency can be improved, as compared with existing air-conditioning apparatuses.

Furthermore, as described above, at the impeller 10, the amount of rise in pressure can be larger than that in existing impellers. Thus, even in the case where the pressure loss in the air passage in the housing 203 is increased by, for example, the heat exchanger 204, the fan 100 can send air at a required flow rate without changing the rotation speed. It is therefore possible to reduce noise made by the fan 100 and the air-conditioning apparatus 200.

In particular, in the fan 100 including the impeller 10 according to Embodiment 3, the wind velocity distribution in an area downstream of the impeller 10 can be more uniformized. Thus, even when the pressure loss in the air passage in the housing 203 is large, it is possible to reduce deterioration of the performance of the fan that is caused by variations in the wind velocity distribution. Therefore, the air-conditioning apparatus 200 including the impeller 10 according to Embodiment 3 can further improve the power efficiency than the air-conditioning apparatus 200 including the impeller 10 according to Embodiment 1.

As described above, the air-conditioning apparatus 200 according to Embodiment 4 includes the impeller 10 according to any one of Embodiments 1 to 3, and the heat exchanger 204 that causes heat exchange to be performed between air supplied by the impeller 10 and refrigerant that flows in the heat exchanger 204. In this configuration, it is possible to improve the power efficiency of the air-conditioning apparatus 200 and to reduce noise made by the air-conditioning apparatus 200.

REFERENCE SIGNS LIST

10 impeller, 11 rotation axis, 12 boss, 20 blade, 21 leading edge, 21*a*, 21*b* inflection point, 22 trailing edge, 23 outer circumferential edge, 23*a* outer peripheral front end, 23*b* outer peripheral rear end, 24 inner circumferential edge, 24*a* inner peripheral front end, 24*b* inner peripheral rear end, 25 pressure surface, 26 suction surface, 27*a*, 27*b*, 27*c* span line, 28 radially middle portion, 30 blade tip vortex, 41 first inflection point, 42 second inflection point, 43 trailing edge area, 44 circumferentially middle area, 45 leading edge area, 80 casing, 81 bell mouth, 100 fan, 200 air-conditioning apparatus, 201 air inlet, 202 air outlet, 203 housing, 204 heat exchanger, 205 wind direction vane

The invention claimed is:

1. An impeller comprising:

a boss provided on a rotation axis; and a blade provided on an outer circumferential side of the boss, the blade having a leading edge that is a front one of edges of the blade in a rotation direction of the blade, a trailing edge that is a rear one of the edges of the blade in the rotation direction, an outer circumferential edge that is an outer circumferential one of the edges of the blade, an inner circumferential edge that is an inner circumferential one of the edges of the blade, and a radially middle portion that is located midway between the outer circumferential edge and the inner circumferential edge in a radial direction of the blade from the rotation axis, where at cylindrical sections of the blade that are located around the rotation axis, a line connecting points that are located from the inner circumferential edge to the outer circumferential edge such that at each of the cylindrical sections, a ratio between a distance from the leading edge to an associated one of the points and a distance from the trailing edge to the associated point is equal to each of those at the others of the cylindrical sections is a span line, and a section of the blade that is taken along the span line and in parallel with the rotation axis is a span-direction section, a span-direction section of part of the blade that adjoins the leading edge is shaped such that part of a suction side of the blade that is located in an area between the radially middle portion and the outer circumferential edge is concave, and a span-direction section of part of the blade that adjoins the trailing edge is shaped such that part of the suction side of the blade that is located in the area between the radially middle portion and the outer circumferential edge is convex, and wherein the cylindrical sections of the blade that are located around the rotation axis include cylindrical sections that are taken along the radially middle portion, taken at a location inward of the radially middle portion, and taken at a location outward of the radially middle portion, and each of the taken cylindrical sections is shaped such that the suction side is convex, and does not have an inflection point between the leading edge and the trailing edge.

2. The impeller of claim 1, wherein the blade has a first inflection point at which a curved shape of the suction side changes such that at part of the span-direction section that adjoins the leading edge, the suction side is concave, and at part of the span-direction section that adjoins the trailing edge, the suction side is convex, and where at the cylindrical sections of the blade that are located around the rotation axis, 0 is a position of the trailing edge in a circumferential direction, and 1 is a position of the leading edge in the circumferential direction, the first inflection point is located at a position in the circumferential direction that falls within a range of 0.2 to 0.7.

3. The impeller of claim 1, wherein a span-direction section of part of the blade that adjoins the leading edge is shaped such that part of the suction side that is located in an area between the inner circumferential edge and the radially middle portion is convex, and the span-direction section of part of the blade that adjoins the trailing edge is shaped such that part of the suction side that is located in the area between the inner circumferential edge and the radially middle portion is concave.

4. The impeller of claim 3, wherein the blade has a second inflection point at which the curved shape of the suction side changes such that at part of the span-direction section that adjoins the leading edge, the suction side is convex, and at part of the spa-direction section that adjoins the trailing edge, the suction side is concave, and where at each of the cylindrical sections of the blade that are located around the rotation axis, 0 is a position of the trailing edge in the circumferential direction, and 1 is a position of the leading edge in the circumferential direction, the second inflection point is located at a position in the circumferential direction that falls within a range of 0.2 to 0.7.

5. A fan comprising:

a casing having a bell mouth; and the impeller of claim 1, the impeller being provided inward of the bell mouth.

6. An air-conditioning apparatus comprising:

the impeller of claim 1; and a heat exchanger configured to cause heat exchange to be performed between air supplied by the impeller and refrigerant that flows in the heat exchanger.

7. The impeller of claim 1, wherein an entirety of the trailing edge is formed into a convex shape as viewed along the rotation axis.

8. The impeller of claim 1, wherein:

the boss has an outer circumferential wall; and the blade has an inner circumferential edge connected to the outer circumferential wall of the boss.

9. The impeller of claim 1, wherein:

the inner circumferential edge meets the leading edge at an inner peripheral front end;

the inner circumferential edge meets the trailing edge at an inner peripheral rear end;

the outer circumferential edge meets the leading edge at an outer peripheral front end; and the outer circumferential edge meets the trailing edge at an outer peripheral rear end, wherein the outer peripheral front end is arranged in front of the inner peripheral front end in the rotation direction of the impeller, and the outer peripheral rear end is arranged in front of the inner peripheral rear end in the rotation direction of the impeller.

* * * * *